US009656369B2

(12) United States Patent
Rattunde

(10) Patent No.: US 9,656,369 B2
(45) Date of Patent: May 23, 2017

(54) BRUSH-TYPE DEBURRING MACHINE FOR MULTIPLE CUTTING WITH INDIVIDUAL DEBURRING

(71) Applicant: RATTUNDE & CO GMBH, Ludwigslust (DE)

(72) Inventor: Ulrich Rattunde, Bentwisch (DE)

(73) Assignee: Rattunde & Co GMBH, Ludwigslust (DE)

( * ) Notice: Subject to any disclaimer, the term of this patent is extended or adjusted under 35 U.S.C. 154(b) by 0 days.

(21) Appl. No.: 14/768,506

(22) PCT Filed: Feb. 10, 2014

(86) PCT No.: PCT/EP2014/052554

§ 371 (c)(1),
(2) Date: Aug. 18, 2015

(87) PCT Pub. No.: WO2014/124902

PCT Pub. Date: Aug. 21, 2014

(65) Prior Publication Data

US 2016/0001419 A1 Jan. 7, 2016

(30) Foreign Application Priority Data

Feb. 18, 2013 (DE) ..... 10 2013 101 580

(51) Int. Cl.

| | |
|---|---|
| ***B24B 41/00*** | (2006.01) |
| ***B21C 37/30*** | (2006.01) |
| ***B24B 29/00*** | (2006.01) |
| ***B24B 9/00*** | (2006.01) |

(52) U.S. Cl.
CPC ..... *B24B 41/005* (2013.01); *B21C 37/30* (2013.01); *B24B 9/007* (2013.01); *B24B 29/005* (2013.01)

(58) Field of Classification Search
CPC B21C 37/30; B24B 1/00; B24B 9/007; B24B 13/0031; B24B 29/005; B24B 41/005
See application file for complete search history.

(56) References Cited

U.S. PATENT DOCUMENTS

| | | | | |
|---|---|---|---|---|
| 1,919,639 A * | 7/1933 | Myers | B24B 27/0023 | 451/184 |
| 2,341,825 A * | 2/1944 | Spicacci | B24B 5/245 | 451/286 |
| 2,795,090 A * | 6/1957 | Sterna | B24B 7/162 | 198/468.1 |

(Continued)

FOREIGN PATENT DOCUMENTS

| | | |
|---|---|---|
| DE | 8016246 U1 | 9/1980 |
| DE | 102010046392 | 3/2012 |

*Primary Examiner* — Timothy V Eley
(74) *Attorney, Agent, or Firm* — Bay State IP, LLC

(57) ABSTRACT

The invention relates to a deburring machine for ends of sections (3, 51) of an elongate profile which are cut to length, with a receiving means (4) for a stack (2) or a bundle (50) of sections (3, 51) and a separating device for the sections (3, 51) of the stack (2) or the bundle (50), with a conveying device for the separated sections (3, 51) and at least one brush (40) which is arranged along the conveying device and which is in contact with the ends of the separated sections (3, 51) during the conveying thereof and which deburrs the ends.

7 Claims, 3 Drawing Sheets

(56) References Cited

U.S. PATENT DOCUMENTS

Figure 1:
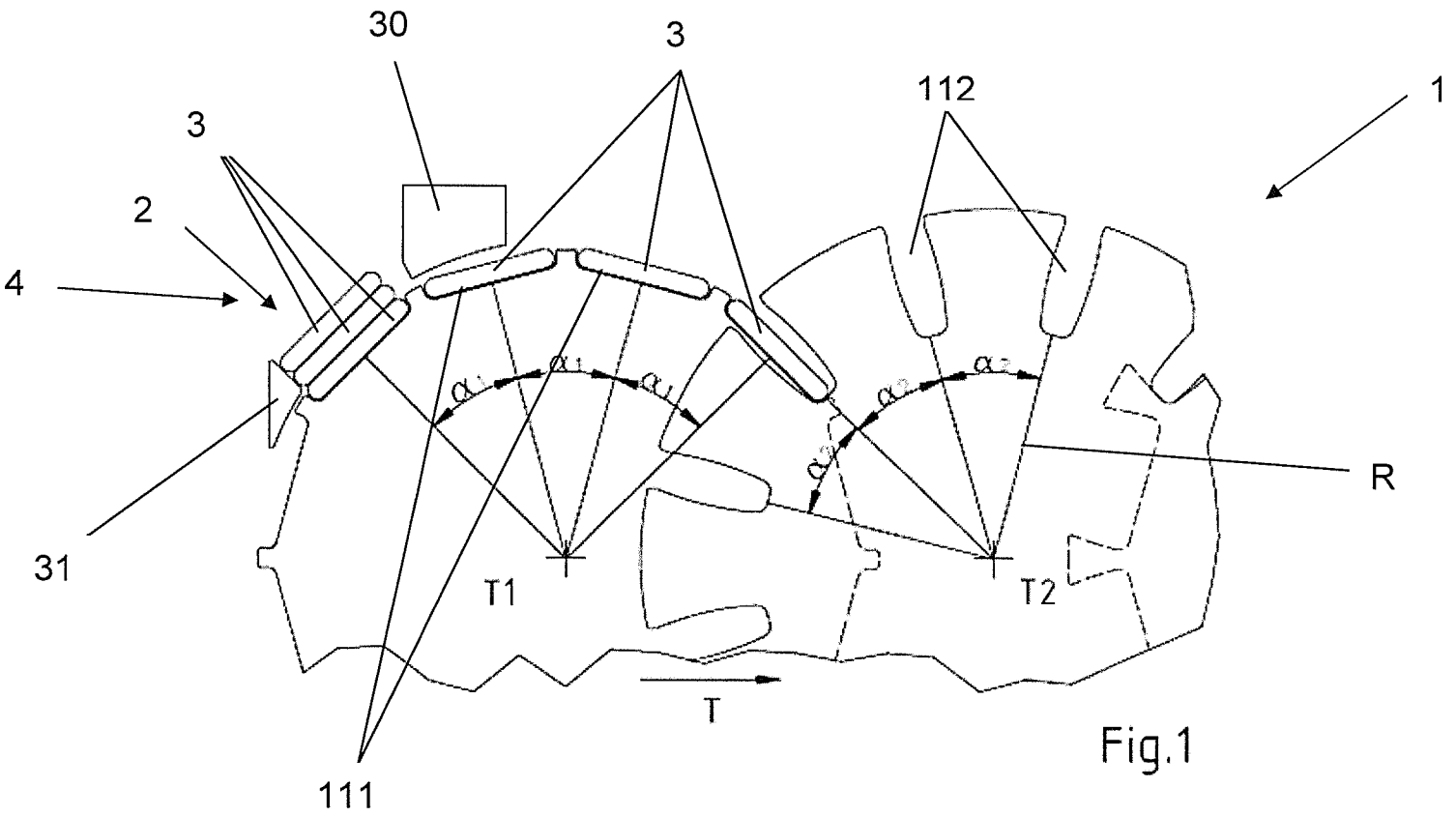

| | | | | | |
|---|---|---|---|---|---|
| 3,045,268 | A * | 7/1962 | Coan | B24B 9/002 | 134/9 |
| 3,112,851 | A * | 12/1963 | Collins | B24B 9/005 | 221/79 |
| 3,311,940 | A | 4/1967 | Spittler | | |
| 6,206,763 | B1 | 3/2001 | Mackall | | |
| 9,138,852 | B2 * | 9/2015 | Rattunde | B08B 1/02 | |
| 2013/0260652 | A1 * | 10/2013 | Rattunde | B21C 37/30 | 451/336 |

* cited by examiner

BRUSH-TYPE DEBURRING MACHINE FOR MULTIPLE CUTTING WITH INDIVIDUAL DEBURRING

CROSS REFERENCE TO RELATED APPLICATION

This application is for entry into the U.S. National Phase under §371 for International Application No. PCT/EP2014/052554 having an international filing date of Feb. 10, 2014, and from which priority is claimed under all applicable sections of Title 35 of the United States Code including, but not limited to, Sections 120, 363, and 365(c), and which in turn claims priority under 35 USC 119 to German Patent Application No. 10 2013 101 580.8 filed on Feb. 18, 2013.

The invention relates to a deburring machine for ends of sections of an elongate profile which are cut to length and to a method of deburring ends of sections of an elongate profile cut to length.

Deburring machines, in particular brush-type deburring machines, are already known in the prior art from DE 10 2010 046 392 A1. As a rule, brush-type deburring machines are not used independenT1y, but in combination with pipe-cutting machines which cut pipe sections to length from a metal pipe at a high cycle rate. The sections cut to length are then further processed. The further processing can be carried out in different successive method steps, and in particular pipe ends can be chamfered and/or washed and/or deburred. During the conveying of the ends and cut faces of the metal pipes by means of conveying discs they are freed by the brush-type deburring machine from sharp burrs which usually remain in the cutting process.

A brush-type deburring machine is known from U.S. Pat. No. 6,206,763 B1, which conveys pipe sections by means of entrainment means along brush rollers rotating in opposed directions. The pipe sections are supplied individually to the brush-type deburring machine.

A brush-type deburring machine, to which pipe sections are supplied individually and are deburred by rotating brush rollers, is disclosed in DE 80 16 246 U1.

In order to increase the number of pieces, elongate profiles are usually not cut to length individually, but stacks of elongate profiles are formed, and stacks of sections are cut to length from the stacks of elongate profiles and are then supplied to a further processing. A drawback of this type of processing in stacks is that the sections—which are arranged one upon the other and are in contact with one another—of elongate profiles cut to length cannot be uniformly processed along the entire periphery thereof in the subsequent steps, and in particular cannot be uniformly deburred, since the sections are mutually screened and protected by the contact.

The object of the present invention is therefore to provide a deburring machine and a method of the type specified in the introduction which avoid or at least reduce the drawbacks specified.

The object is attained in a first aspect by a deburring machine specified in the introduction and with the feature of claim 1 and in a second aspect by a method with the features according to claim 9.

Preferred embodiments of the deburring machine and of the method form the subject matter of the respective Sub-Claims.

The deburring machine according to the invention is characterized on the one hand by a receiving means for a stack or a bundle of sections of an elongate profile which are cut to length as well as by a separating device for the sections and a conveying device for the separated sections as well as at least one brush which is arranged along the conveying device and which preferably rotates and which is in contact with the ends of the separated sections during the conveying of the separated sections and which by means of the rotation deburrs the cut faces of the sections cut to length.

The deburring machine according to the invention makes it possible in a simple manner for a multiple cutting which is important for the speed of the sawing procedure to be retained, by stacks or bundles of elongate profiles being cut to length and by the stacks or bundles of sections which are formed as a result being further processed. Each individual section is nevertheless subjected by the separating device to individual processing by the brushes, and the deburring procedure is therefore carried out just as meticulously as if the sections were cut to length individually from the elongate profile and were supplied individually to a further processing, in particular the deburring.

In a preferred embodiment of the invention the conveying device has two rows—arranged adjacent to each other in the conveying direction—of conveying discs which have pairs of notches mutually opposed at a right angle to the conveying direction for receiving the individual sections. Each row of conveying discs comprises even-numbered and odd-numbered conveying discs which are arranged offset from one another and which overlap one another in part. In this case the terms "even-numbered" and "odd-numbered" refer to the numbering of the conveying discs which continues in the conveying direction. The even-numbered conveying discs are coupled to one another, and the odd-numbered conveying discs are coupled to one another.

The receiving means into which the stack or the bundle of sections is first introduced is dimensioned so as to receive a plurality of sections. The notches in the conveying discs, however, are dimensioned so as only to receive a single section in each case. The notches arranged opposite one another in pairs allow an individual section cut to length to be received. The sections cut to length are capable of being advanced by the rotation of the conveying discs in the conveying direction. The rotation is preferably carried out in a clock-timed manner and in the same direction of rotation during each clock cycle.

In a particularly preferred embodiment of the invention the receiving means comprises alternating pairs of individual notches and at least one stop arranged upstream of the receiving means in the direction of rotation of the first conveying disc and one holding means arranged downstream of the stack-receiving means in the direction of rotation. The receiving means is therefore designed to be capable of being altered during the entire deburring procedure of a stack or bundle of sections, so although it has a constant stop and a constant holding means, it nevertheless has alternating pairs of notches.

In a preferred embodiment of the invention the stack or the bundle of sections is capable of being inserted directly into the receiving means upon immediate contact with the notch. If the notch is not positioned in such a way that it is part of the receiving means, the stack or the bundle will come into direct contact with the conveying disc. If the conveying disc, however, has not turned so far that one of the notches is part of the receiving means, then the entire stack or the entire bundle is capable of being inserted into the receiving means in such a way that precisely one section is preferably positioned in the associated notch and makes contact with the wall of the notch.

In a preferred embodiment of the invention a device for transferring the stack or the bundle of sections from a cutting device directly into the receiving means of the deburring machine is provided. The transfer device is preferably designed in the form of a gripper which grips the sections simultaneously cut to length as a stack or bundle and inserts them as a stack or bundle into the receiving means where they come into direct contact with the associated notch or the pair of notches respectively.

It is advantageous for odd-numbered notches of an odd-numbered conveying disc to have a greater length along the periphery than a depth in the radial direction, and for notches of an even-numbered conveying disc to have a shorter length along the periphery than a depth in the radial direction. On account of the arrangement of successive even-numbered and odd-numbered conveying discs with the respective notches it is possible even for profiles which are not rotationally symmetrical in cross-section, for example flat oval profiles, to be transferred from one pair of conveying discs to the next pair.

In a further embodiment of the invention angular distances of adjacent notches of even-numbered and odd-numbered conveying discs are made different from one another.

In a second aspect the invention is attained by a method of deburring ends of a section of an elongate profile cut to length, preferably by means of one of the deburring machines described above, by a stack or bundle of sections cut to length being placed in a receiving means, by the sections of the stack or bundle being separated and by the separated sections then being conveyed along a conveying direction and by the ends, preferably the cut faces, being brushed during the conveying. What is essential to the invention is that despite the insertion of a stack or bundle of sections cut to length into a deburring machine the actual brushing procedure takes place individually for each section and the whole stack is not just brushed as a stack.

It is advantageous for the first pair of conveying discs to be rotated in a continuous, clock-timed manner in a constant direction of rotation, and for a lowermost, radially innermost section of the stack or bundle of sections to be entrained in the conveying direction during each clock cycle and then to be transferred to the second pair of conveying discs.

It is preferable for a plurality of stacked elongate profiles to be simultaneously cut to length and for the stack or the bundle of sections cut to length to be inserted into a receiving means.

It is preferable for the stack or the bundle to be inserted directly into the receiving means, in which case too the receiving means has a notch in the correct position of the first pair of conveying discs, so that when the stack or the bundle is inserted into the receiving means it advantageously comes into contact immediately with a wall of the notch of the first pair of conveying discs, so that the inserted stack or the inserted bundle need not roll just towards the notch, but the sections of the stack or the bundle are directly separated and are conveyed at the same time by the conveying disc.

Figure 2:
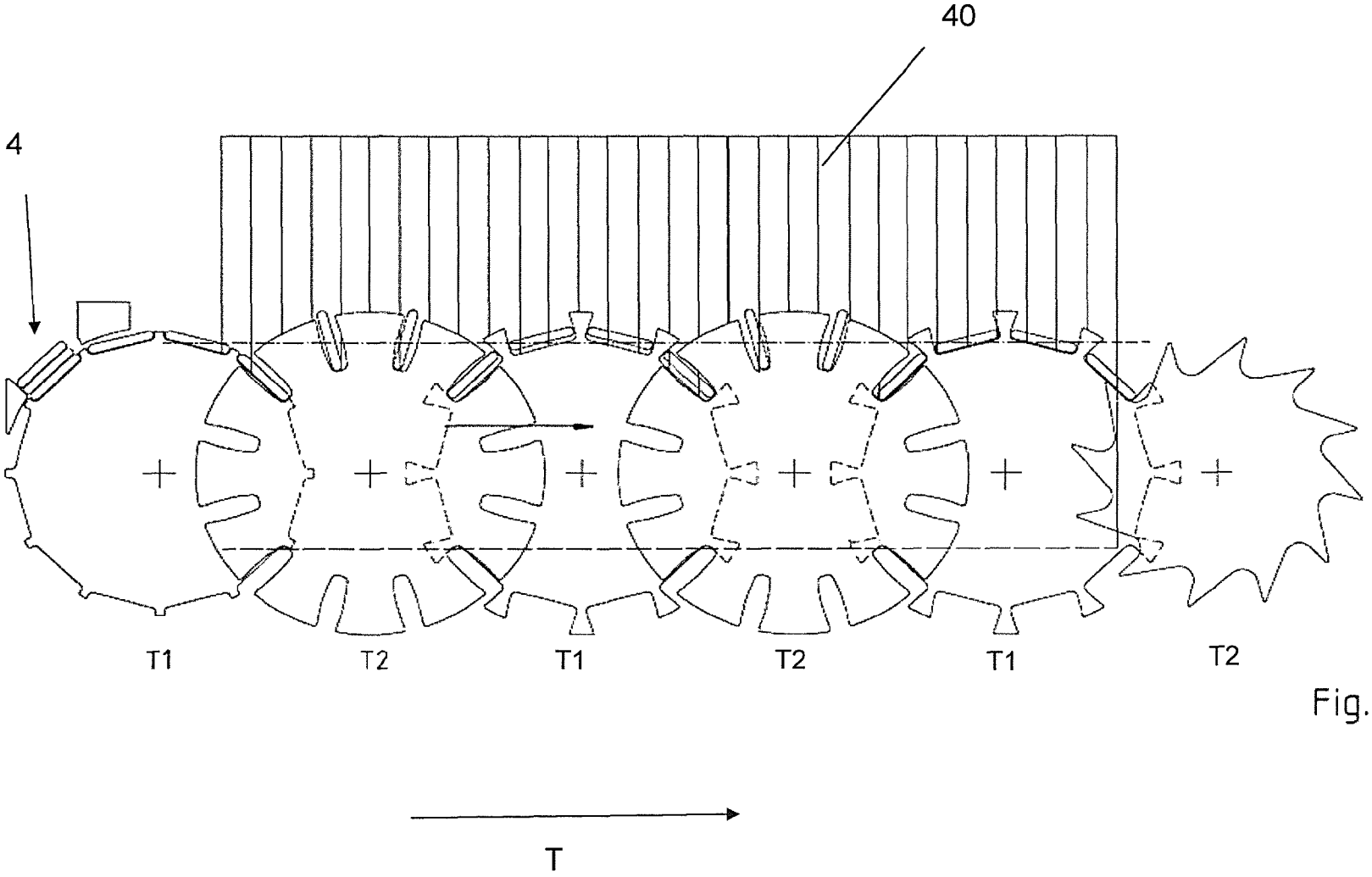
Figure 3:
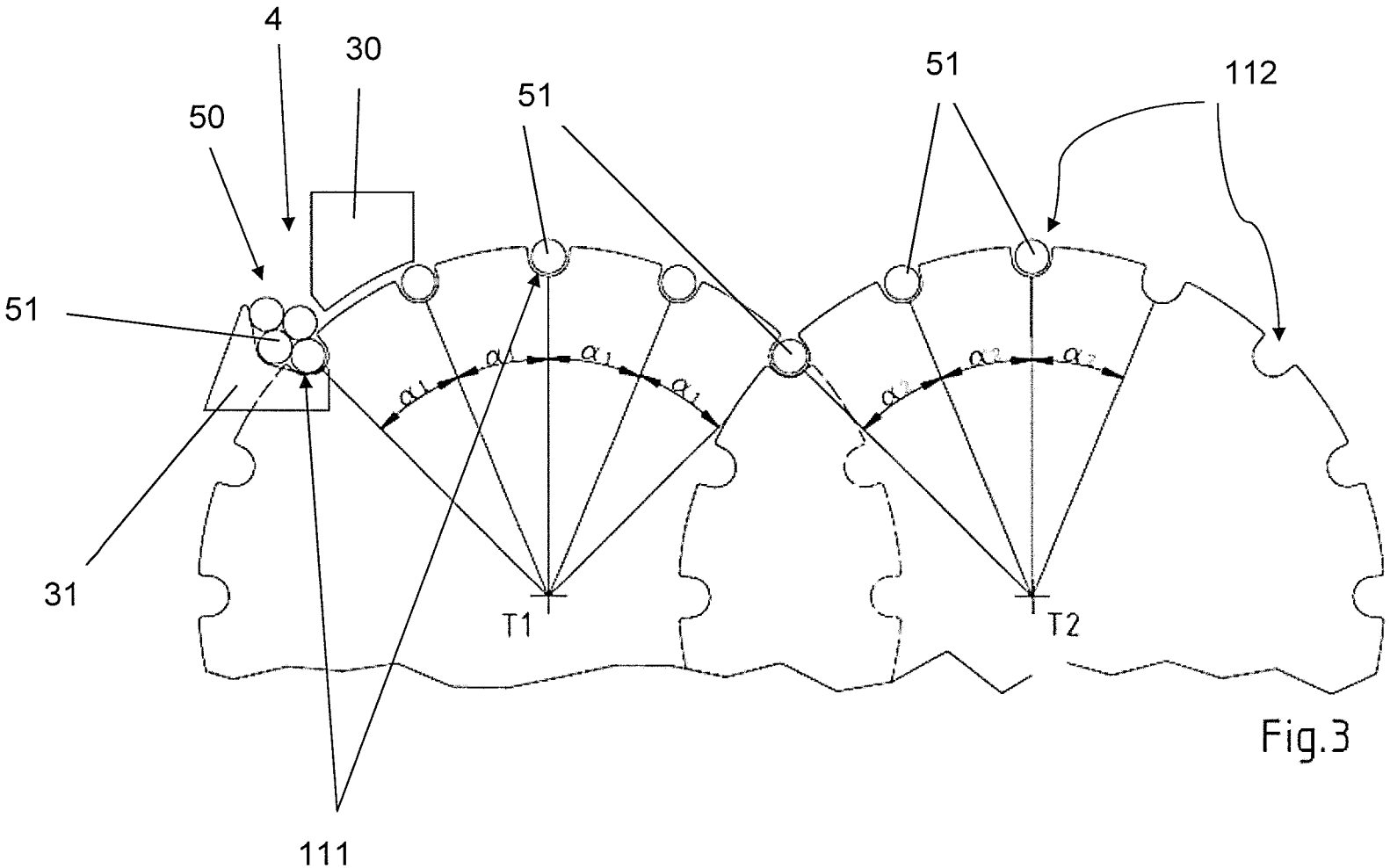

The invention is described in three figures with reference to two embodiments. In the drawing FIG. 1 is a partial view of a brush-type deburring machine for receiving a stack of flat oval profiles;

FIG. 2 is a perspective view of a brush-type deburring machine as shown in FIG. 1, and FIG. 3 is a detailed view of a brush-type deburring machine for receiving a bundle of pipe sections.

A cut-away view of a brush-type deburring machine 1 is shown diagrammatically without brushes in FIG. 1. Brush-type deburring machines 1 are provided at the end of a sequence of processing steps for cutting sections of a metal hollow or solid profile to length.

FIG. 1 shows a brush-type deburring machine 1 for deburring flat oval profile sections 3 cut to length which are inserted in stacks 2 into the brush-type deburring machine. Flat oval profile sections 3 are to be understood as cross-sections pipe cross-sections flattened at a right angle to the longitudinal direction of the section. A longest external diameter is longer, in particular 10%, 20%, 30% or 50% or even twice as long as or still longer than a smallest external diameter. Length ratios between the length ratios specified are also possible. The cross-section is hollow on the inside. The flat oval profile sections 3 can be cut to length from a single elongate profile or, as shown in FIG. 1, simultaneously from a stack of elongate profiles and can then be inserted as a stack 2 of flat oval profile sections 3 into a stack-receiving means 4.

In FIG. 1 three metal elongate profiles of flat oval cross-section are stacked one above the other and are sawn off at the same time. The three sawn-off flat oval profile sections 3 resulting after the cutting and arranged one above the other are gripped as a stack of three 2 by a gripper (not shown) and are inserted into the stack-receiving means 4 of the brush-type deburring machine 1.

The brush-type deburring machine 1 has conveying discs $T_1$, $T_2$ arranged opposite one another in pairs. The pairs of conveying discs are arranged along a conveying direction T. The conveying discs $T_1$, $T_2$ are arranged offset from one another in the conveying direction T and allow the flat oval profile sections 3 to be conveyed along the conveying direction T by rotation and transfer. While they are conveyed along the conveying direction T the outermost ends of the flat oval profile sections 3 are deburred by being conveyed along a rotating brush (not shown in FIG. 1) arranged in their longitudinal axis in the conveying direction T. The rotating brush removes on the one hand cuttings formed during the sawing procedure and remaining on the cutting face of the flat oval profile section 3 and on the other hand, however, also the sharp burr formed on the edge of the cutting face as a result of sawing off the flat oval profile sections 3. The sharp burr can extend completely around the outside of the end face of each of the flat oval profile sections 3.

As shown in FIG. 1, pairs of odd-numbered conveying discs $T_1$ are arranged closer to one another in the conveying direction than the pairs of even-numbered conveying discs $T_2$. As a result, it is possible for the odd-numbered conveying discs $T_1$ and the even-numbered conveying discs $T_1$ to be arranged overlapping one another and, in this way, for the transmission of single flat oval profile sections 3, as illustrated in FIG. 1, from a pair of conveying discs $T_1$ to the directly adjacent pair of conveying discs $T_2$ to be made possible.

The first and the odd-numbered conveying discs $T_1$ are provided along their outermost periphery with flat, long odd-numbered notches 111 which are adapted to the size of the cross-section of the conveyed flat oval profile section 3. Each odd-numbered notch 111 is designed to receive precisely one end portion of a flat oval profile section 3. The flat oval profile section 3 rests at its two end portions on one conveying disc $T_1$, $T_2$ of the pair of conveying discs in each case and is conveyed by the rotation of the conveying discs $T_1$ to the next pair of conveying discs $T_2$ and is transferred in the region of the overlap.

The even-numbered notches 112 of the second and even-numbered conveying discs $T_2$ are likewise adapted to the cross-sections of the flat oval profiles, but the even-numbered notches 112 are arranged along the periphery of the even-numbered conveying discs $T_2$ and are rotated by 90° with respect to the odd-numbered notches 111 of the odd-numbered conveying discs $T_1$ about an axis at a right angle to the conveying direction T, so that the even-numbered notches 112 are made narrow along the periphery of the even-numbered conveying discs $T_2$ but are made deep along a radius R. A depth of the even-numbered notches 112 substantially corresponds to a long diameter of the flat oval profile section 3, whilst a width of the even-numbered notches 112 substantially corresponds to the short diameter of the flat oval profile section 3, whilst the depth and width of the odd-numbered notches 111 are dimensioned in a precisely reversed manner.

The conveying discs $T_1$, $T_2$ rotate in an alternating and clock-timed manner along the conveying direction. The clock-timed rotation of the even-numbered conveying discs $T_2$ is adapted to the clock cycle of the odd-numbered conveying discs $T_1$. With clock-timed rotation of the odd-numbered conveying discs $T_1$ the latter are advanced by an angle $\alpha l$ which essentially corresponds to the length of the odd-numbered notch 111 plus the distance from a directly following odd-numbered notch 111. The rotation of the odd-numbered conveying discs $T_1$ is then stopped. After the odd-numbered conveying discs $T_1$ are stopped, on the one hand the next flat oval profile section 3 drops into the next odd-numbered notch 111, and on the other hand even-numbered and odd-numbered notches 111, 112 overlap by one flat oval section in the stopping position of the odd-numbered conveying discs $T_1$. After the rotation of the first conveying discs $T_1$ is stopped, the even-numbered conveying discs $T_2$ rotate in one cycle by an angle $\alpha 2$ which essentially corresponds to the width of the even-numbered notches 112 plus the distance of two even-numbered notches 112 from each other. The even-numbered conveying discs $T_2$ stop at the end of the cycle in a position in which the even-numbered notches 112 are arranged along the periphery of the odd-numbered conveying discs $T_1$ in a side view. There the even-numbered conveying discs $T_2$ are stooped, and the first conveying disc $T_1$ in turn rotates about an angle $\alpha 1$ in a following cycle. The angles $\alpha 1$ and $\alpha 2$ are of equal magnitude in this case.

The stack-receiving means 4 forms a separating device for the flat oval profile sections 3 of the inserted stacks 2. The separating device comprises a stop 30 fixed in position with respect to a frame (not shown) of the brush-type deburring machine 1, as well as a rear holding means 31 and two flat odd-numbered notches 111 alternating in the stepping cycle of the pair of odd-numbered conveying discs $T_1$.

After the stack 2 of flat oval profile sections 3 cut to length has been inserted into the stack-receiving means 4, the side of the flat oval profile section 3 facing the odd-numbered conveying discs $T_1$, i.e. the side of the flat oval profile section 3 radially on the inside, rests in the flat odd-numbered notch 111 and it fills the latter substantially completely. In particular, a radial periphery of the odd-numbered conveying discs $T_1$ extends along the radially outer side of the flat oval profile section 3 inserted into the odd-numbered notch 111. As a result of the rotation of the first conveying discs $T_1$ the flat profile section 3 radially on the inside is drawn away under the stack 2. The other two flat oval profile sections 3 are pressed against the stop 30 and are prevented by the stop 30 from rotating further. After the end of the first cycle the following empty odd-numbered notch 111 is positioned in the stack-receiving means 4. The now lowermost flat oval profile section of the stack 2 drops into the free odd-numbered notch 111 and the next cycle starts. In this case so many cycles are carried out until the entire stack 2 of flat oval profile sections 3 is removed. After that, a new stack 2 of flat oral profile sections 3 is inserted into the stack-receiving means 4. The stepwise clock-timed removal of the stack is the separation of the flat oval profile sections 3.

As a result of the separation of the sawn-off flat oval profile sections 3 it is made possible for the rotating brush to remove completely the burr formed along the entire periphery of the cutting face of the section 3. In particular, the burr can also be removed at those points which are in contact with one another in the stack arrangement and are therefore not accessible or are accessible only with difficulty for a rotating brush.

FIG. 2 shows diagrammatically the entire brush-type deburring machine 1 as shown in FIG. 1 with two odd-numbered conveying discs $T_1$ and two even-numbered conveying discs $T_2$ as well as a separating device with a stack-receiving means 4 and a rotating brush 40 for deburring the cutting faces of the separated flat oval profile sections 3.

FIG. 3 shows an embodiment of the brush-type deburring machine 1 which is different from FIG. 1 and which is intended for receiving a bundle 50 of circular profile sections 51, in this case four. The circular profile sections 51 are inserted in a bundle 50 of four sections into a bundle-receiving means 4 which in turn comprises a stop 30 leading in the direction of rotation of the first conveying discs $T_1$ and a trailing holding means 31. The radial depth of the first notches 111 of the odd-numbered conveying discs $T_1$ is thus dimensioned in such a way that it essentially corresponds to a diameter of the circular profile sections 51. In this case too, as in the embodiment as shown in FIG. 1, the circular profile sections 51 are pulled out under the remaining bundle 50 of the circular profile sections 51 by stepwise clock cycles and are advanced in the conveying direction T with the first conveying discs $T_1$.

The odd-numbered and even-numbered conveying discs $T_1$ and $T_2$ are arranged with respect to one another in the two embodiments in such a way that the taking-over and transfer of the sections 3, 51 is arranged rotated by an angle of 90° along the conveying disc $T_1$, $T_2$ so that in the case of a brush-type deburring machine 1 for deburring a stack 2 of precisely two sections of a double section the even-numbered and odd-numbered notches 111, 112 are in each case at an angular distance of $\alpha_1=\alpha_2=45°$ from one another, with a threefold section they are at an angular distance of $\alpha_1=\alpha_2=30°$ from one another, and with a four-fold section they are at an angular distance of $\alpha_1=\alpha_2=22.5°$ from one another.

LIST OF REFERENCES

1 brush-type deburring machine
2 stack
3 flat oval profile section
4 receiving means / stack-receiving means / bundle-receiving means
30 stop
31 holding means
40 brush
50 bundle
51 circular profile section
111 odd-numbered notch
112 even-numbered notch
R radius
T conveying direction T1 odd-numbered conveying discs
T2 even-numbered conveying discs
α1 angle
α2 angle

The invention claimed is:

1. A deburring machine for ends of sections (3, 51) of an elongate profile which are cut to length, with a receiving means (4) for a stack (2) or a bundle (50) of separated sections (3, 51) and the receiving means (4) forming a separating device for the sections (3, 51) of the stack (2) or the bundle (50), with a conveying device for the bundle of separated sections (3, 51) and at least one brush (40) which is arranged along a conveying device and which is in contact with the ends of the separated sections (3, 51) during the conveying thereof and which deburrs the ends characterized in that the conveying device has two rows—arranged adjacent to each other in a conveying direction (T)—of conveying discs (T1, T2), which have pairs of notches (111, 112) mutually opposed at a right angle to the conveying direction (T)for receiving an individual section (3, 51) and the stack (2) or the bundle (50) of sections (3, 51) is capable of being inserted directly into the receiving means (4) upon immediate contact with the notches (111, 112).

2. A deburring machine according to claim 1, characterized in that the receiving means (4) comprises:

alternating pairs of notches (111); and, at least one stop (30), wherein the at least one stop is arranged upstream of the alternating pairs of notches and fixed in position.

3. A deburring machine according to claim 2, characterized in that the receiving means (4) has at least one holding means (31) arranged downstream of the pair of notches in a direction of rotation (T).

4. A deburring machine according to claim 1, characterized by a transfer device of the stack (2) or the bundle (50) of sections from a cutting device directly into the receiving means (4) of the deburring machine.

5. A deburring machine according to claim 1, characterized in that odd-numbered notches (111) of odd-numbered conveying discs (T1) have a greater length along the periphery than a depth in the radial direction (R), and even-numbered notches (112) of even-numbered conveying discs ($T_2$) have a shorter length along the periphery than a depth in the radial direction (R).

6. A deburring machine according to claim 1, characterized in that angular distances ($\alpha_1$, $\alpha_2$) of adjacent notches (111, 112) of even-numbered and odd-numbered conveying discs ($T_1$, $T_2$) are different from one another.

7. A method of deburring ends of sections (3, 51) of an elongate profile which are cut to length, with a deburring machine (1) according to claim 1, wherein a stack (2) or bundle (50) of sections (3, 51) cut to length is placed in a receiving means (4), the sections of the stack (2) or bundle (50) are separated, the separated sections (3, 51) are conveyed along a conveying direction (T) and the ends of the sections (3, 51) are brushed during the conveying, characterized in that a first pair of conveying discs (T1) is rotated in a continuous, clock-timed manner in one direction and entrains a radially innermost section (3, 15) of the stack (2) or bundle (5) in the conveying direction (T)during each clock cycle and transfers it to a second pair of conveying discs (T2), a plurality of stacked or bundled elongate profiles are simultaneously cut to length and the stack (2) or the bundle (50) of sections (3, 51) cut to length is interested directly into the receiving means (4) and the stack (2) or the bundle (50) inserted into the receiving means immediately comes into contact with a wall of the notch (111, 112) of the first pair of conveying discs (T1) after being inserted into the receiving means (4).

* * * * *